United States Patent [19]

Solomon

[11] Patent Number: 5,022,327

[45] Date of Patent: Jun. 11, 1991

[54] CRANK TOP OVERBED TABLE

[75] Inventor: Robert A. Solomon, Kalamazoo, Mich.

[73] Assignee: Bissell Healthcare/Bissell Am Fab, Inc., Kalamazoo, Mich.

[21] Appl. No.: 548,375

[22] Filed: Jul. 5, 1990

[51] Int. Cl.[5] ..... A47B 9/00

[52] U.S. Cl. ..... 108/147; 108/144

[58] Field of Search ..... 108/144, 145, 146, 147, 108/148, 157

[56] References Cited

U.S. PATENT DOCUMENTS 2,628,147 2/1953 Berner ..... 108/146

2,749,197 6/1956 Smith ..... 108/147

3,207,099 9/1965 Black et al. ..... 108/147

*Primary Examiner*—Kenneth J. Dorner

*Assistant Examiner*—Gerald A. Anderson

*Attorney, Agent, or Firm*—Price, Heneveld, Cooper, DeWitt & Litton

[57] ABSTRACT

A bedside table having a safety top that is free to rise from any prior set level when upward pressure is applied. The table has a gear driven lead screw for setting the height of the table relative to a patient bed. If, for any reason, the patient bed should rise, the table top will safely rise with the bed regardless of the height to which it has previously been set.

11 Claims, 1 Drawing Sheet

CRANK TOP OVERBED TABLE

BACKGROUND OF THE INVENTION

The typical overbed table has a pair of telescopically mounted, vertical, rectangular tubes supported on a movable frame. A table top is mounted on one of the vertical tubes and it is then movable up and down relative to the other vertical tube and the ground support or floor support frame. A flat steel spring is fastened to the movable tube and then extends downwardly to the bottom of the second tube where it is tightly coiled. The spring is held by a latch which prevents the spring from drawing in the portion of the spring attached to the table top. When the table top is to be moved, the latch releases the coil spring and the table top is lifted against the pull of the spring. When it is desired to lower the table top, the latch is again released and the inherent tendency of the spring to coil pulls the table top downward. The table top and frame are fastened together and, while the table top is movable, it is biased or continually drawn downward by the spring.

If a patient is in bed and the table top described above is extended over the bed, and the bed is inadvertently caused to rise, either by a nurse or by the patient, the patient will be pushed upwardly against the bottom of the overbed table and possibly injured, depending on the existing condition of the patient. Also, if someone rushes to the aid of the patient and releases the latch on the overbed table, the table will tend to descend further rather than rise away from the patient.

SUMMARY OF THE INVENTION

In accordance with the present invention, an overbed table is provided which has a table top which can be raised or lowered by means of a hand crank. In the event the table top is extended over a patient and the patient, or another person, inadvertently raises the bed so that the patient is pressed against the bottom of the table top, the table top will rise protecting the patient from possible injury.

In accordance with the present invention, an overbed table is provided having a safety top. The table top is capable of extending over a bed. A frame supports the table top on the floor. A drive mechanism is supported by the frame and can be used for controllably moving the table top upwardly or downwardly relative to the frame. The table top is free to move upwardly on the application of an upward force regardless of the position of the table top determined by the drive mechanism.

DETAILED DESCRIPTION OF THE PREFERRED EMBODIMENT

Figure 1:
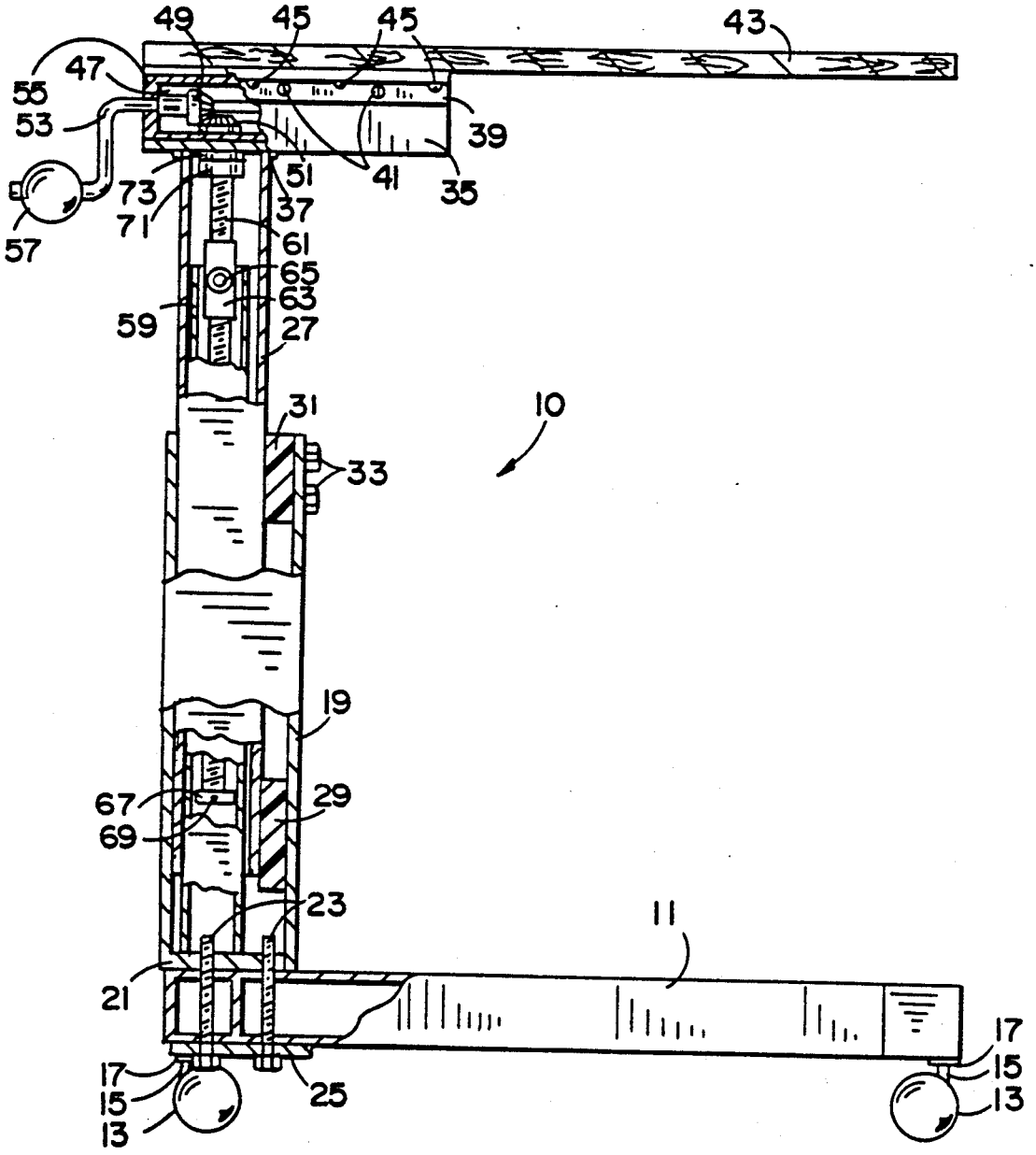
FIG. 1 is an elevational view of the overbed table of the present invention, partially broken away, showing the drive mechanism normally concealed within the decorative frame.

Referring to FIG. 1, the overbed table is shown and indicated generally by the number 10. The overbed table has a floor contacting frame 11 which can be of any convenient shape. For example, the frame 11 can be of a rectangular box-like configuration to provide stability for the frame. It can also be an open "I" configuration having an elongated central member capped off at either end by centrally positioned orthogonal members.

The frame 11 is supported by spaced wheels 13 which are mounted on vertical supporting shafts 15 which are in turn inserted into suitable sockets 17 at the extremities of the frame.

In the description to follow, terms such as "up," "down," "left," "right," "top" and "bottom" will be in relation to FIG. 1. A first vertical column 19 has a bottom plate 21 which is preferably welded to the column for increased strength. The vertical column 19 is bolted to the frame 11 by a pair of threaded bolts 23 which pass through a reinforcing plate 25 and are then threaded into threaded apertures in the plate 21. A second vertical tube 27 is mounted within the first vertical tube 19 and can move upwardly and downwardly in the first vertical tube. The vertical tubes 19 and 27 are preferably made of rectangular steel tubing which provides strength and also limits the horizontal rotation of the table top relative to the frame 11. Round tubing can also be used in the construction of the overbed table. If round tubing were used, it would be preferred to have the inner tube keyed to the outer tube to again limit the horizontal rotation. The overbed table of the present invention can also be made with the movable tube, the inner tube as shown, outside of the first vertical tube and movable up and down on the outer surface. All of the aforementioned constructions are within the scope of the present invention.

A plastic spacer 29 is fastened to the lower outer surface of tube 27. A second spacer 31 is fastened to the inside of vertical tube 19, near the top thereof, by a pair of spaced bolts 33. The spacers 29 and 31 are preferably made of an organic polymeric material such as Teflon or nylon which has a natural lubricating feel to it. The spacer 29 stabilizes the bottom of tube 27 and also functions as a limit stop for movement of the tube 27 in an upward direction. Attached to the top of tube 27 is a horizontally mounted channel-shaped member 35 which is preferably welded at 37 to form a solid weld assembly between the channel member 35 and the vertically movable tube 27. Extending left and right along each side of the upper edge of channel member 35 are a pair of angle members 39, only one of which is shown in FIG. 1. The vertical side of the angle member 39 is fastened along the upper edge of the channel member 3 by suitable fasteners 41. The horizontal side of the angle member 39 is fastened to the table top 43 by suitable fasteners 45. The angle member 39 could be welded to channel member 39; however, for ease of maintenance of the table, it is preferred to use fasteners to hold the angle member in place. Suitable fasteners are threaded screws, bolts and nuts, etc. The top 43 is preferably made of a pressed material such as masonite. It could also be made of plywood or particle board. In view of the nature of the top 43, the fasteners 45 can be screws which can be threaded into the bottom surface of the top 43.

Within the channel-shaped member 35, and above that portion where it is welded to vertical tube 37, is mounted a gear box 47 which contains a pair of interconnected bevel gears 49 and 51, respectively, which are mounted with their axes at right angles. Bevel gear 49 is fastened to crank shaft 53 which passes through an aperture in end wall 55 of the gear box 47 and continues and passes through an in-line similar aperture in the end wall of the gear box 47 (not shown). The remainder of shaft 53 has two right angle bends to shape it as a crank and has a ball hand grip 57 rotatably mounted thereon.

A third vertical tube 59 is mounted within vertical tubes 19 and 27 and rests upon the upper surface of plate 21. A lead screw 61 is journaled in a nut 63 which is fixed in the top of the tube 59 and fastened in place by a fastener 65. The tube 59 is preferably of a square configuration; however, as previously discussed, it can also have a rectangular or circular configuration. The lead screw 61 is approximately 20 inches long and ½-inch in diameter. The lead screw has an Acme thread of 5 turns per inch. This number of turns per inch has been found preferable in providing upward and downward movement of table top 43 without undue exertion in the movement of crank 53. A nut stop 67 is fastened to the bottom of lead screw 61 by a pin 69 to prevent the lead screw from being totally removed from threaded nut 63. Lead screw 61 acts upon a thrust collar 71 which is separated from the bottom of the gear box 47 by a nylon bushing 73. The lead screw 61 is fastened to bevel gear 51 by a pin (not shown) which passes through the lead screw and the collar of the bevel gear to firmly secure them in place.

In the operation of the overbed table, the table can be rolled into place next to a bed and the top 43 can be adjusted by turning the crank 53 which, in turn, causes lead screw 61 to exert pressure against thrust collar 71 and bushing 73 to push welded assemblies 27 and 35 upwardly when the table is raised. Likewise, when the table is to be lowered, the crank 53 can be turned which causes the lead screw to rotate in the opposite direction threading itself downwardly in nut 63 into nut retainer tube 59. If the overbed table 10 is in position over a hospital bed or a patient bed, and the bed is inadvertently raised, the bed will rise and contact the lower surface of table 43 causing it to rise regardless of the position of the crank 53 and lead screw 61 since the entire assembly merely rests upon plate 21 at the bottom of tube 19. The nut retainer tube 59 is not fastened to plate 21 but merely rests upon this surface allowing the entire assembly to rise until plastic spacer 29 contacts spacer 31 which would be in an extremely extended position beyond the height which a bed could reach, including a bed with a patient therein.

If the overbed table were extended over a patient and the bed caused to inadvertently rise, the body of the patient would contact the lower surface of table top 43 and would cause the entire assembly, as described above, to rise without injuring the patient.

It can be seen from the above description that an extremely safe overbed table has been invented for use in patient care. With this table the patient need never worry about being caught between the bed and the overbed table if the bed is raised either by the patient or by another person. Also, the vertical portion of the table top is controlled by a simple hand crank. There is no latch to release, and no springs tending to pull the table top downward when released.

Though the invention has been described with respect to a specific preferred embodiment thereof, many variations and modifications will become apparent to those skilled in the art. It is therefore the intention that the appended claims be interpreted as broadly as possible in view of the prior art to include all such variations and modifications.

The embodiments of the invention in which an exclusive property or privilege is claimed are defined as follows:

1. An overbed table having a safety table top comprising:

a table top capable of extending horizontally over a bed;

a frame for supporting said table top;

a drive mechanism resting on said frame for controllably moving said table top upwardly and downwardly relative to said frame;

said table top being free to move upwardly relative to said frame, while being maintained in its horizontal orientation by said frame, upon the application of an upward force directly to said table top regardless of the position of said table top determined by said drive mechanism.

2: An overbed table as set forth in claim 1 wherein said drive mechanism rests on said frame and is not connected to said frame.

3. An overbed table as set forth in claim 1 wherein said drive mechanism comprises:

a pair of interconnected bevel gears with their axes of rotation set at right angles to one another;

a hand crank for rotating one of said bevel gears;

a lead screw connected to the other of said bevel gears, said lead screw being caused to rotate by said hand crank;

an upstanding tube supported by said frame;

a nut supported in said upstanding tube, said lead screw being journaled for rotation in said nut, whereby rotation of said hand crank will cause said lead screw to rotate in said nut causing said table top to move upwardly or downwardly depending on the direction of rotation of said hand crank.

4. An overbed table as set forth in claim 1 wherein said table top and said drive mechanism can be raised upwardly off said frame upon the application of an upward force to said table top.

5. An overbed table having a safety table top comprising:

a supporting frame;

a threaded support for a lead screw resting on said frame;

a lead screw journaled in said support;

a gear box for rotating said lead screw;

a table top on said gear box for movement upwardly or downwardly in accordance with the rotation of said lead screw;

said table top, gear box, lead screw and threaded support for said lead screw being severable from said supporting frame on the application of an upward force to said table top.

6. An overbed table comprising:

a supporting frame;

a first upstanding tube fastened to said supporting frame;

a second upstanding tube mounted in said first upstanding tube for movement in a first direction out of said tube and in a second direction into said tube;

a third upstanding tube positioned within said first and second upstanding tubes;

a gear box attached to the end of said second upstanding tube;

a pair of cooperating bevel gears in said gear box;

a hand crank connected to one of said bevel gears;

a lead screw mounted for rotation in a nut supported by said third upstanding tube and connected to said other bevel gear;

a table top attached to said gear box and enabled to be raised and lowered by rotation of said hand crank, said table top being free to move upwardly relative to said supporting frame and said first tube upon the application of an upward force regardless of the position of the table top determined by said hand crank.

7. An overbed table as set forth in claim 6 including:

a first spacer mounted on said second tube near the lower edge thereof;

a second spacer mounted on an inner surface of said first tube near the top edge thereof;

said first and second spacers cooperating to guide the movement of said second tube in said first tube and limiting the upward movement of said second tube.

8. An overbed table as set forth in claim 7 wherein said first and second spacers are made of an organic polymeric material.

9. An overbed table as set forth in claim 7 wherein said first and second spacers limit the movement of said second tube and said table top to a safe position above a bed.

10. An overbed table as set forth in claim 6 including:

a horizontally disposed channel-shaped member joined to the top of said second tube and extending over a portion of said supporting frame with the sides of said channel-shaped members extending upwardly;

said gear box being disposed in said channel-shaped member above said second tube;

said table top being disposed on said channel-shaped member and said gear box.

11. An overbed table as set forth in claim 10 including:

a pair of angle members having a first side and a second side at a right angle to said first side;

one of said angle members being fastened to each side of said channel-shaped member, said first side of each angle member being fastened at the upper edge of each side of said channel-shaped member, said second side of said angle member being fastened to said table top.

* * * * *

UNITED STATES PATENT AND TRADEMARK OFFICE

CERTIFICATE OF CORRECTION

PATENT NO. : 5,022,327

DATED : June 11, 1991

INVENTOR(S) : Robert A. Solomon

It is certified that error appears in the above-identified patent and that said Letters Patent is hereby corrected as shown below:

Column 2, line 44:
"member 3" should be --member 35--

Signed and Sealed this

Twenty-second Day of December, 1992

*Attest:*

DOUGLAS B. COMER

*Attesting Officer*

*Acting Commissioner of Patents and Trademarks*